United States Patent [19]

Johnson et al.

[11] 4,269,881

[45] May 26, 1981

[54] ANTI-STATIC MATS AND CARPETS

[75] Inventors: Donald C. Johnson, Fremont; Walter L. Burdorf, Port Clinton, both of Ohio

[73] Assignee: Ludlow Corporation, Needham Heights, Mass.

[21] Appl. No.: 733,136

[22] Filed: Oct. 18, 1976

[51] Int. Cl.[3] ..... B32B 5/18

[52] U.S. Cl. ..... 428/95; 156/72; 428/97

[58] Field of Search ..... 428/85, 95, 97, 78; 57/146, 149, 150, 151, 152, 153, 154, 155, 140 R, 140 BY, 157 AS; 156/72

[56] References Cited

U.S. PATENT DOCUMENTS

| | | | |
|---|---|---|---|
| 3,582,445 | 6/1971 | Okuhashi | 57/157 AS |
| 3,746,573 | 7/1973 | Hotta | 428/95 |
| 3,804,699 | 4/1974 | Johnson | 428/78 |
| 3,955,022 | 5/1976 | Sands | 428/95 |

*Primary Examiner*—Marion McCamish

*Attorney, Agent, or Firm*—Robert A. Cesari; John F. McKenna; Andrew F. Kehoe

[57] ABSTRACT

A novel carpet material or mat which is characterized by an extraordinary ability to quickly and comfortably discharge any build-up of a static electricity charge on a person who has built up such a charge, say, by walking across conventional carpeting. The novel material is constructed with a backing which has a low dissipation factor and relatively low volume and surface conductivity, with a conductive thread in the pile and with an electroconductive tufting substrate sheet.

15 Claims, 4 Drawing Figures

ANTI-STATIC MATS AND CARPETS

BACKGROUND OF THE INVENTION

It has long been desirable to provide a carpeting material which suitably dissipates build up of static electricity without being positively grounded. The need for effective static dissipation is particularly urgent in computer rooms and the like. Heretofore, carpetings have been provided which contained metallic threads and other such means to diminish static electricity. Also, positive grounding of such carpets with wires and nails has been effective, albeit inconvenient in many circumstances.

However, there is no art known which suggests the particular combination of constructions to be disclosed below, particularly in view of their extraordinary ability to dissipate static electricity without causing discomfort to pedestrians who have walked off, or who are walking upon the carpet.

In a hindsight evaluation of the invention, it may be said that it is a unique extension and combination of elements relating to all of the following areas of generally recognized art:

(1) carpets comprising conductor elements;
(2) sheets containing conductive fillers; and
(3) mats comprising foam and plastic backing.

SUMMARY OF THE INVENTION

Therefore, it is a principal object of the present invention to provide a novel walk-off carpet material having improved ability to dissipate static electricity, without annoying electrical discharges, from a person stepping off a conventional carpet onto the carpet of the invention.

Another object of the invention is to provide a carpet which helps avoid static build up on a person walking across the carpet.

Another object of the invention is to provide processes for making such a carpet and a novel process for avoiding static electricity type discharges.

It is a particular object of the invention to provide a carpet that resists static build up, as several people use it in sequence, without using a positive electrical connection to ground.

Other objects of the invention will be obvious to those skilled in the art upon their reading of this disclosure.

The above objects have been achieved by uniting the following elements in a single walk-off mat construction:

(1) A conductive tufting yarn, of the type described in U.S. Pat. No. 3,723,811. A nylon yarn of this type is commercially available form Dow Badische Company of Williamsburg, Va., under the trade designation Y-514S and is wholly suitable for use in the products of the invention. In the product of the invention, it is suitable to utilize a product having less than 1%, indeed as low as 0.2%, by weight of conductive fiber. One conductive fiber advantageously used is that of the type sold by Dow Badische Company under the trade designation F-901. This is a nylon-type of yarn impregnated or coated with conductive carbon. It is more break-resistant that metal yarns of the prior art and, consequently, the electroconductivity thereof is more durable in the products of the invention.

(2) A conductive tufting substrate which incorporates an electroconductive carbon in a sufficient quantity to provide the desired conductivity. The carbon should be incorporated in such a way as to avoid being washed or leached from the substrate. The substrate is advantageously formed of an ethylene vinyl acetate polymer within which a conductive carbon black is dispersed to yield a resistivity of 300,000 ohms per square or less, but most advantageously 200,000 ohms or less.

(3) A backing comprising:

(i) a vinyl based material and (ii) a polymeric foam, advantageously a low density urethane reticulated foam forming the floor-contacting side of the backing and of the rug. The backing is conveniently of the type generally described in U.S. Pat. No. 3,804,699, i.e. of the type previously used in mats to achieve a creep-resistant property. Usually the foam is largely impregnated by the polymer-based composition, but a distinct non-impregnated portion of foam forms the bottom of the backing.

An exemplary backing is described below. Although Applicant does not wish to be bound by the theory, it is presently believed that an important factor in achieving the advantageous properties of the mat is the D.C. Surface Resistivity ohm/sq as measured by NFPA Method 2, 76-1969 of the AATCC (USAS L14-112-1961). In this test, the applied voltage should be 100 volts per inch of the interelectrode spacing.

Such a material, typically, has a D.C. volume resistivity of $8.3\times10^{10}$ (ASTM 991) and a Dissipation Factor of from 0.15 to 0.07 depending on the frequency (0.1 KHZ to 100.0 KHZ).

The dielectric constant of such a backing will typically range from 3.025 to 2.359 over the same frequency range.

The backing advantageously comprises, as the floor-touching surface, a thin compressible polymeric foam material of the open-cell type. Reticulated polyurethane foam is convenient. It may have a density of 1.5 to 5 lbs per ft.$^3$ and a thickness of 0.05 to 0.15 inch.

The facing and backing are known in the art. The substrate, in its broadest aspect, is also known. However, they had not been combined into a structure according to the invention. On being so combined it is unexpectedly found that a near perfect walk-off mat is achieved, i.e. a mat that is substantially equivalent to a positively grounded mat in its utility.

The reason that carpets and mats of the invention which comprise the more resistive backing material perform so well, e.g. as in FIG. 4, is not precisely known. In general, it seems that the rugs act as large capacitors which absorb most of the charge when a person steps on it. When the person subsequently grounds himself, only a small charge remaining on the person is immediately discharged. The residual charge on the rug will be dissipated over a few seconds without being in any way noticed by the person. The particular importance of the invention is that several people can walk over the mat in succession without a bothersome build-up in static discharge being experienced by any of them.

Backings of the more resistive type seems to be best. Without being bound by the theory, it is suggested that this unexpected advantage is achieved because charge leakage into and though the backing is reduced, thereby assuring a broader dissipation of the charge through the tufting substrate. It is believed that the most advantageous carpets of the invention comprise backings with volume resistivities of at least $5\times10^{10}$ ohm-cm. The surface resistivity is preferably of the order of $1\times10^{11}$; but it is believed that this latter parameter is less important than the volume resistivity. A dielectric constant of below about 4 (frequency of 1 kilohertz) is also believed to be advantageous.

It has been determined that about 3,000 static volts is the maximum voltage build-up that can be generally tolerated by a cross-section of users without annoyance or discomfort on contact with ground. Thus, it is an object of the invention to provide a mat which:

(1) will provide a means to reduce the static level to 3,000 volts or less from, typically, 7,000 to 12,000 static volts, immediately upon a "charged" person stepping onto the mat; or (2) will minimize the voltage build up by a person walking on the carpeting material.

Thus, there are two important uses of a novel carpet as disclosed herein. First, it may be used as a carpet on a major part of the floor area, say wall-to-wall in a computer operations room. In such a use, it will readily dissipate static electricity and prevent undesirably high static build-up on personnel traversing the rug.

Another use is simply as a "walk-off" mat. Such mats are used not only to solve substantive technical problems, but also to avoid the annoyance and discomfort of static discharge, and, after they leave the conventional carpet, but before touching ground, step onto a carpet according to the invention, thereby dissipating the static charge to a level where no discomfort will be experienced when they subsequently touch ground.

ILLUSTRATIVE EMBODIMENT OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

IN THE DRAWINGS

Figure 1:
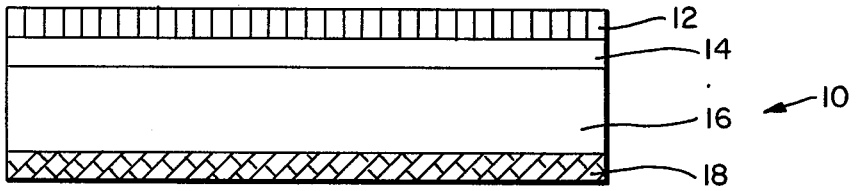
FIG. 1 is a schematic drawing of a section of a walk-off carpet constructed according to the invention.

FIG. 1 shows a section of carpet 10 of the invention with the conductive yarn facing bearing 12, tufting substrate 14, and the backing comprising vinyl formulation 16 and split polyurethane foam 18.

Figure 2:
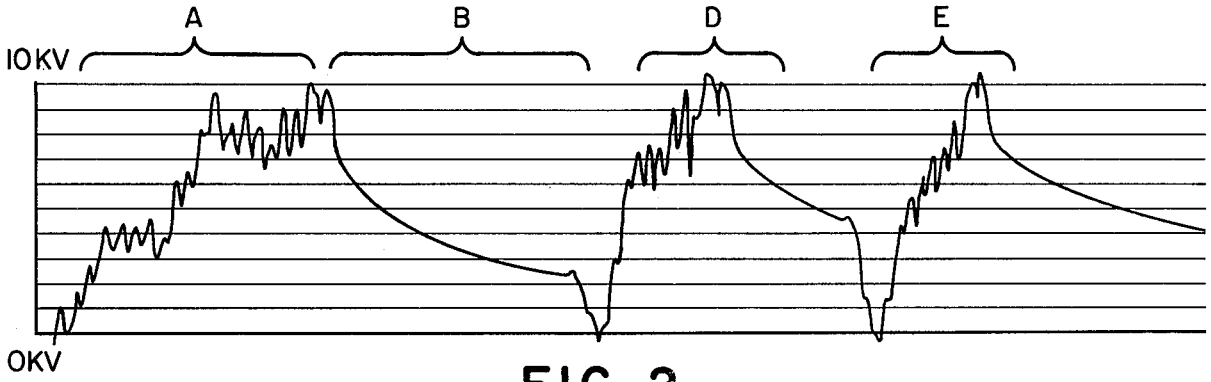
FIG. 2 is a graph illustrating what takes place when a number of people walk over a conventional prior art walk-off carpet with no grounding, but with some construction features intended to reduce electric shock.
Figure 3:
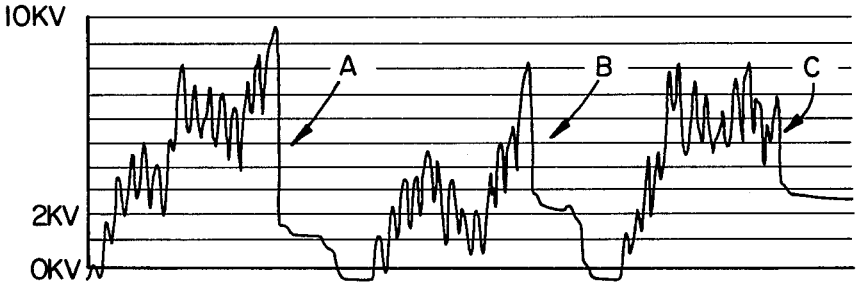
FIG. 3 is a graph illustrating the qualitative performance of a walk-off carpet indicating a build-up of voltage as three people "walk off" sequentially, onto it.
Figure 4:
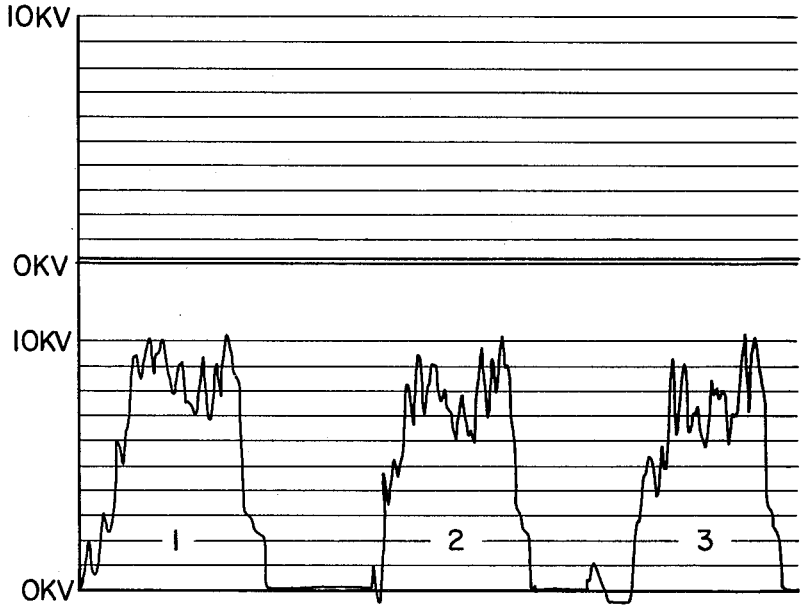
FIG. 4 is a graph illustrating performance of a walk-off carpet constructed according to the invention.

Referring to FIGS. 2 through 4, it is seen that the ordinate of each graph is in kilovolts, a measure of the static charge built up on a person walking across, or stepping onto, a carpet. The abscissa is a measure of time in seconds.

FIG. 2 illustrates a conventional prior art walk-off mat with some provision for reducing the static voltage built up by people walking onto the mat, i.e. a conductive facing as is preferred in practice of the invention. However, the tufting substrate does not bear conductive grade carbon and the backing is with glass bubbles that is reported hereinafter. It serves as a good model for describing the phenomena whereby, as seen at A, a person walks across a conventional carpet and builds up a voltage on his person. At B he has left the mat. However, he still carries a slowly-diminishing voltage that can result in an uncomfortable discharge until about point C or after.

Also, note that somewhat higher voltages are built up and maintained by other people walking across the mat.

FIG. 3 is similar to FIG. 2 with the exception that the tufting substrate comprises conductive grade carbon black. This is a major improvement over the performance of the mat of Example 2, because, for example, the first two people across the mat (as indicated at A and B) have their static charges reduced to somewhere about 2KV respectively as they leave a conventional carpet and step onto the walk-off mat. However, it is noted that the residual charge increases for each person, and that the third person has dropped to a static voltage level of only about 3KV after stepping on the mat. This is a level at which a substantial number of people will receive a discomforting shock.

FIG. 4 illustrates the effect when three people, each bearing a high static charge, stroll from a conventional carpet onto a preferred walk-off mat constructed according to the invention, i.e. using a vinyl backing with a split foam and having an electroconductive tufting substrate and conductive facing. There is no substantial build-up in the value of the residual charge on sequential people. The drop in charge to a level of about 3 kilovolts is very fast, typically less than about 0.0002 seconds.

In manufacture of the carpet of the invention, the wear surface is typically designed to have a cut pile of 16 ounces per square yard of the carpet facing yarn described above as comprising conductive carbon bearing filaments. This yarn is tufted (at 3/16 inch gauge, 4 stitches per inch, ¼ inch pile height) into a non-woven conductive substrate described above.

Manufacture of the Carpet

After the substrate has been tufted and cut into mat sizes it is laid into a vinyl plastisol which provides together with substrate and forms the backing for the mat and, if desired, a border around the mat. The backing may be applied as described in U.S. Pat. No. 3,804,699. About 4.5 to 5 lbs of vinyl composition are added per square yard.

A backing formula (or bonding composition as it is called) is disclosed in U.S. Pat. No. 3,804,699. Such a backing is used in the rug of FIG. 4 described above, has a D.C. surface resistivity of about $5.5\times10^{10}$ ohms per square, a volume resistivity of $1.37\times10^{10}$.

Another backing formulation useful in practice of the invention is as follows:

| Formula A | Lbs. |
|---|---|
| Dioctyl Phthalate, plasticizer | 345 |
| Zinc-base stabilizer* | 4 |

-continued

| Formula A | Lbs. |
|---|---|
| Blowing agent (dispersed in 50% in DOP)** | 3 |
| Pigment | 12 |
| CaO | 11 |
| $CaCO_3$ (Whiting) | 150 |
| Dispersion Grade Vinyl Resin | 450 |
| Glass microsphere filler | 40 |

*sold under the trade designation 5019 by Ferro Corp.
**the agent is sold under the trade designation Celogen OT by Uniroyal Corp.

Electrical Properties of Backings

| Sample | Freq. K Hz | Dielectric Constant | Dissipation Factor | DC Volume Resistivity ohm-cm[1] | CD Surface Resistivity ohm/sq[2] |
|---|---|---|---|---|---|
| Formula A | 0.1 | 6.395 | 0.33 | $1.37 \times 10^{10}$ | $5.46 \times 10^{10}$ |
| | 1.0 | 5.539 | 0.11 | | |
| | 10.0 | 4.829 | 0.11 | | |
| | 100.0 | 3.969 | 0.14 | | |
| (Patent 3,824,699) | 0.1 | 3.205 | 0.15 | $8.3 \times 10^{10}$ | $1 \times 10^{11}$ |
| | 1.0 | 2.845 | 0.06 | | |
| | 10.0 | 2.612 | 0.06 | | |
| | 100.0 | 2.359 | 0.07 | | |

Temperature 23° C.
Relative Humidity 47.5%
1 Spec: ASTM 991
2 Spec: NFPA; Method 2, 76-1969 of the AATCC (USAS L14-112-1961). Applied voltage should be 100 volts per inch of inter-electrode spacing. The measured resistivity shall be less than $1 \times 10^{11}$ ohms per unit square of material It has now been discovered that suitable tufting substrates can be achieved by dispersing therein a suitable amount of electroconductive carbon black.

A tufting substrate suitable for use can be prepared by preparing a non-woven fabric of a blend of regular and high tenacity polyester staple fibers. Typical yarns are those sold under the trade designation E-1, 4212, Type 61G and Type 5576 by DuPont, Barnet, Wellmon and Leight companies, repsectively. These fibers are opened, formed into a dry web using apparatus known to the art (e.g. a webber of the type sold by Rando Corp.) and then needled according to the art. Thereupon, the web is saturated with a binder using a pad-type saturator, oven dried and calendered to appropriate thickness, e.g. about 0.032 inchs and about 4.4 ounces per square yard, all as known in the art.

A binder system having a suitable conductivity is formed of a mixture of the following ingredients:

| Formula | Parts by Weight (wet) |
|---|---|
| Water | 11.04 |
| Defoamer (silicone type) | 0.049 |
| Polymeric binder (ethylene vinyl acetate)[1] | 37.4 |
| Carbon Black Dispersion[2] (8% solids) | 50.0 |
| Surfactant[3] | 0.497 |
| Fire Retardant Additive[4] | 1.000 |

[1]sold under the trade designation Elvace 1875 by Dupont.
[2]sold under the trade designation Vulcanite 533 by Alco Chemical Co.
[3]sold under the trade designation Aerosol OT by American Cyanamid.
[4]sold under the trade designation LV T23P by Michigan Chemical Company.

This tufting substrate material is conveniently of a weight of about 4 to 5 ounces per square yard, and a thickness of about 0.025 to 0.040 inches. It should have a tensile strength of at least 45 lbs in the cross machine direction, and a trapezoid tear strength of (ASTM D1117) of at least 22 lbs. The percent of fiber is preferably at least 66% of the entire weight of the substrate.

It is also to be understood that the following claims are intended to cover all of the generic and specific features of the invention herein described and all statements of the scope of the invention which might be said to fall there between.

What is claimed is:

1. Carpet product adapted to minimize the static voltage on a person using the carpet, said carpet comprising
(a) a facing yarn comprising some electrically conductive fibers therein.
(b) a tufting substrate forming means to hold said facing yarn and formed of a fabric having a maximum resistivity of 300,000 ohms per square
(c) a polymer-based backing adherent and adjacent to said tufting substrate, said backing itself having a layer of low-density polymeric foam of high electrical resistivity adherent thereto, said foam forming the bottom of said carpet product and wherein said backing has a minimum volume resistivity of about $5 \times 10^{10}$ ohm-cm$^{-1}$.

2. A carpet as defined in claim 1 wherein said conductive fibers are synthetic polymer fibers bearing conductive carbon thereon.

3. A carpet as defined in claim 2, wherein said tufting substrate has a resistivity of less than 200,000 ohms per square.

4. A carpet as defined in claim 3, wherein said carpet is effective to reduce the static voltage of a person walking thereto from 12,000 volt level to a 3,000 volt level within seconds.

5. A carpet as defined in claim 1 wherein said polymeric foam is a polyurethane foam.

6. A carpet as defined in claim 5, wherein said tufting substrate has a resistivity of less than 200,000 ohms per square.

7. A carpet as defined in claim 6, wherein said carpet is effective to reduce the static voltage of a person walking thereto from 12,000 volt level to a 3,000 volt level within seconds.

8. A carpet as defined in claim 1, wherein said tufting substrate has a resistivity of less than 200,000 ohms per square.

9. A carpet as defined in claim 8, wherein said conductive fibers are synthetic polymer fibers bearing conductive carbon thereon.

10. A carpet as defined in claim 8, wherein said carpet is effective to reduce the static voltage of a person walking thereto from 12,000 volt level to a 3,000 volt level within seconds.

11. A carpet as defined in claim 10 wherein said carpet is effective to reduce the static voltage of a person walking thereon from a 12,000 volt level to a 2,000 volt level.

12. A carpet as defined in claim 11 wherein said facing yarn is a cut pile.

13. A carpet as defined in claim 1 wherein said carpet is effective to reduce the static voltage of a person walking thereto from 12,000 volt level to a 3,000 volt level within seconds.

14. A carpet as defined in claim 1, 8 or 10 wherein said facing yarn is a cut pile.

15. A process for reducing static electricity on a person walking across a yarn-faced carpet of the type comprising conductive fibers in said yarn, said process comprising the steps of (a) conducting electricity from said fibers into a fibrous substrate in intimate contact with said yarn, said substrate having a resistivity of less than 200,000 ohms per square.

(b) providing a polyer-based backing composition in intimate contact with said substrate, said polymer based backing having a minimum volume resistivity of about $5\times10$ ohm-cm$^{-1}$ and forming means to resist the conduction of electricity therethrough, thereby facilitating lateral dissipation of electricity through said fibrous substrate.

* * * * *

UNITED STATES PATENT AND TRADEMARK OFFICE

CERTIFICATE OF CORRECTION

PATENT NO. : 4,269,881

DATED : May 26, 1981

INVENTOR(S) : Donald C. Johnson and Walter L. Burdorf

It is certified that error appears in the above-identified patent and that said Letters Patent are hereby corrected as shown below:

Column 1, line 66 - Change "that metal yarns" to --than metal yarns--.

Column 5, line 22 - Change "(Patent 3,824,699)" to --(Patent 3,804,699)--.

Signed and Sealed this

Eighteenth Day of August 1981

[SEAL]

Attest:

GERALD J. MOSSINGHOFF

Attesting Officer

Commissioner of Patents and Trademarks